US005948177A

United States Patent [19]

Longwell et al.

[11] Patent Number: 5,948,177

[45] Date of Patent: Sep. 7, 1999

[54] COLLET METAL TREATING PROCESS

[75] Inventors: John F. Longwell; Donald N. Terwilliger, both of Elmira, N.Y.

[73] Assignee: Hardinge Inc., Elmira, N.Y.

[21] Appl. No.: 09/039,414

[22] Filed: Mar. 16, 1998

Related U.S. Application Data

[60] Provisional application No. 60/040,800, Mar. 17, 1997.

[51] Int. Cl.[6] ..... C21D 1/06; C23C 8/48; C23C 8/50

[52] U.S. Cl. ..... 148/228; 148/217

[58] Field of Search ..... 148/228, 217

[56] References Cited

U.S. PATENT DOCUMENTS

| | | | |
|---|---|---|---|
| 3,753,799 | 8/1973 | Wells | 148/228 |
| 4,184,899 | 1/1980 | Blas et al. | 148/228 |
| 5,735,971 | 4/1998 | Wahl et al. | 148/217 |

*Primary Examiner*—Deborah Yee
*Attorney, Agent, or Firm*—Pillsbury Madison & Sutro LLP

[57] ABSTRACT

A method of surface treating a metallic machine tool element includes heating the element prior to insertion of the metal element into a nitrating salt bath for the purpose of both hardening the element and improving the resilience of portions required to be flexed in use.

8 Claims, 1 Drawing Sheet

COLLET METAL TREATING PROCESS

This case is a provisional of application Ser. No.60/040,800 filed Mar. 17, 1997

FIELD OF THE INVENTION

The present invention relates to improvements in the manufacture of machine tool collets, and more specifically, to a chemical treatment to improve the durability and operation of collets and similar devices used in machine tool operations.

BACKGROUND OF THE INVENTION

In the manufacture of collet assemblies for use with machine tools such as lathes or other forming tools, it has been the practice to manufacture a collet with a plurality of fingers that are deflected during use to effect a holding action on a tool or a workpiece. A number of designs are available to impart this flexing motion to the arms of a collet with the workpiece typically inserted through a central bore which is defined by an opening between the deflecting arms. In many applications, the force imparted on a tool or workpiece held between the arms or jaws of a flexible collet will vary with the rotational speed imparted to the collet from a drive shaft. In many cases, where the article held by the collet is unevenly balanced, premature failure of the collet can occur particularly in the case of collets that have had their parts formed by casting followed by machining.

SUMMARY OF THE INVENTION

The present invention provides a method for treatment of a collet for operation over a broad range of speeds and one which will improve the surface hardness of the metal of the collet and impart a resilience to or increase an inherent degree of resiliency in the arms or fingers of the collet to provide secure locking on a tool or a workpiece. In a preferred embodiment, according to the present invention, a metallic collet that has been formed by casting or machining of raw metal stock is subjected to a chemical treatment to harden the surface of the metal. It has been discovered that a conventional metal treatment such as the known Melonite (trademark of Kolene Corporation) process, as described below, not only will provide improved surface hardness for raw metal but will also impart a resilience to a portion of metal at least at the free end thereof that has previously not been obtainable for typical metal stocks that are available for use in machine tools.

The foregoing and other advantages will become apparent as consideration is given to the following detailed description and accompanying examples and the attached drawings, in which:

DETAILED DESCRIPTION OF THE INVENTION

Figure 1:
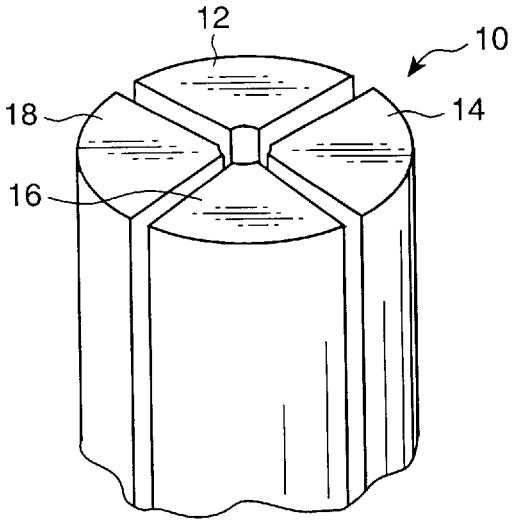
FIG. 1 is a schematic, perspective view of a flexible collet.
Figure 2:
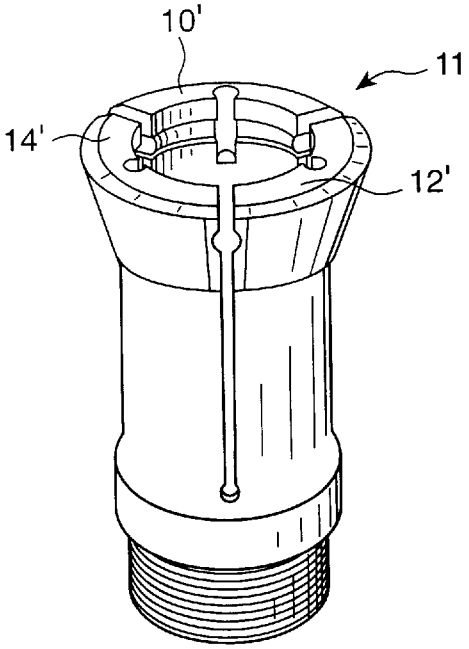
FIG. 2 is a perspective view of another collet variant.

According to the present invention, a steel collet member such as disclosed in commonly assigned U.S. Pat. No. 5,397,135 granted Mar. 14, 1995 may be made from steel metallic stock and formed by cutting slots in the walls of a tubular member with the central bore of the tubular member shaped by machining to grip a tool or workpiece for use on a machine tool spindle. Such a collet is schematically shown in FIGS. 1 at 10, a four arm type and FIG. 2 at 11, a three arm version. Typically, a draw bar will be employed to impart a force through a camming action to the four arms, 12, 14, 16, 18 or 10', 12' or 14' of FIG. 2, of the collets 10 and 11 to enable the collet to lock onto and hold a tool or workpiece in position as relative rotation between the tool and workpiece is carried out.

Since modern day CNC machines operate at relatively high rotational velocities, it has become necessary to harden at least the surface of the metal stock used in the collet. Typically, this has been done in the past by an expensive and time consuming heat treatment where a workpiece is placed in an oven and subjected to elevated temperatures for a selected length of time depending on the size of the collet.

The present invention avoids this energy expense and time delay inherent in the prior art process by using a heat treatment commercially known as the Melonite process. In the Melonite process, a metal workpiece is treated chemically in a bath made from constituents that are commercially available from a variety of companies. The Kolene Corporation of Detroit, Mich. has several varieties of chemical constituents available for forming an appropriate bath for the type of metal to be treated. In the literature, treatment with a cyanide and carbonate salt of sodium and potassium will provide a nitriding salt bath. The bath may be provided with a metered aeration system. In a typical process, the metal workpiece or pieces are first cleaned and then placed in a preheating furnace to raise the temperature of the metal so as to avoid cooling the nitriding bath as well as thermal shock to the workpieces. The articles are then immersed in the nitriding salt baths for a period of time sufficient to form a diffusion layer over the entire element. Clearly, to obtain a penetration of 0.02 inches to 0.4 inches will depend on the concentration of the cyanate and carbonate salts in the bath, the temperature of the bath and the extent of aeration that is carried out in the bath. A treatment of one to two hours is typical and has been found to increase endurance by 25 to 35% in most grades of steel. Austenitic steels have been known to develop an extremely hard and complex compound zone on the order of 0.0007 inches to 0.0009 inches thick. The temperature of the bath is approximately 1000° F. and need not exceed 1100° F. An oxidizing salt bath such as the type available in the market and known as KQ5000 should be employed following the salt bath treatment.

Subsequent to the quenching step, the treated members are cooled to room temperature and then rinsed. The oxidizing salt treatment has the advantage that it completely destroys any residual cyanide that appears in the process.

Surprisingly, it has been found that this treatment when applied to a collet structure improves the resilience of the fingers of the collet while hardening the treated surfaces of the collet. This is a significant advantage in terms of machine tool operation as the life of the collet will be greatly enhanced while improving retention of a workpiece or a tool during a machining operation. This is done without resorting to the relatively more expensive use of spring metals in the formation of the collet which latter metals have inherent weaknesses in terms of either furnace or chemical hardening treatments which are necessary to enable such elements to be used in a wide range of machines and operations.

We claim:

1. A method for improving the resiliency of fingers of a metallic machine tool collet, comprising the steps of:

inserting the metallic machine tool collet into a heated nitriding salt bath for a period of time sufficient to form a desired depth of surface treatment of the metallic machine tool collet.

2. A method as in claim 1, comprising the further steps of:

inserting the metallic machine tool collet into a heated oxidizing salt bath following treatment in the nitriding salt bath.

3. A method as in claim 2, comprising the further steps of:

preheating the metallic machine tool collet prior to insertion into the nitriding salt bath.

4. A method as in claim 3, comprising the further steps of:

cleaning the metallic machine tool collet prior to the preheating.

5. A method as in claim 1, wherein the nitriding salt bath includes cyanide, carbonate salt of sodium and potassium.

6. A method as in claim 1, wherein the nitriding salt bath is maintained at a temperature in the range of about 900° F. to 1100° F.

7. A method as in claim 6, wherein the nitriding salt bath is maintained at a temperature of approximately 1000° F.

8. A method as in claim 1, comprising the further step of:

aerating the nitriding salt bath during treatment of the metallic machine tool collet.

* * * * *